United States Patent [19]

Leeves

[11] Patent Number: 4,757,945

[45] Date of Patent: Jul. 19, 1988

[54] ELECTRICALLY INSULATING DEVICE FOR USE ON A RAILWAY TRACK UNDER AND BESIDE THE FOOT OF A RAIL

[75] Inventor: Geoffrey G. Leeves, Bearsted, England

[73] Assignee: Pandrol Limited, London, England

[21] Appl. No.: 6,992

[22] Filed: Jan. 27, 1987

[30] Foreign Application Priority Data

Jan. 30, 1986 [GB] United Kingdom ..... 8602277

[51] Int. Cl.[4] ..... E01B 9/68

[52] U.S. Cl. ..... 238/107; 238/265; 238/283; 238/382

[58] Field of Search ..... 238/107, 265, 264, 283, 238/285, 287, 292, 304, 306, 382

[56] References Cited

U.S. PATENT DOCUMENTS

| | | | |
|---|---|---|---|
| 2,713,974 | 7/1955 | Lofton | 238/283 |
| 4,208,011 | 6/1980 | Dahlhaus et al. | 238/281 |
| 4,231,908 | 11/1980 | Pennino | 238/283 X |
| 4,239,156 | 12/1980 | Skinner et al. | 238/277 |
| 4,632,307 | 12/1986 | Weber | 238/283 X |
| 4,648,554 | 3/1987 | McQueen | 238/283 |

FOREIGN PATENT DOCUMENTS

| | | |
|---|---|---|
| 0169685 | 1/1986 | European Pat. Off. . |
| 2717394 | 10/1978 | Fed. Rep. of Germany . |
| 2855407 | 12/1978 | Fed. Rep. of Germany . |
| 1093133 | 11/1954 | France . |
| 739432 | 10/1955 | United Kingdom . |
| 834320 | 5/1960 | United Kingdom . |
| 967329 | 8/1964 | United Kingdom . |
| 1427974 | 3/1976 | United Kingdom . |
| 2051187 | 1/1981 | United Kingdom . |
| 2106570 | 4/1983 | United Kingdom . |
| 2114635 | 8/1983 | United Kingdom . |

*Primary Examiner*—Sherman D. Basinger
*Attorney, Agent, or Firm*—Norbert P. Holler

[57] ABSTRACT

A device to be placed on a railway sleeper (1) or some other foundation for a railway rail (3) includes a pad (2) and two upstanding portions (6A). The pad (2) is of resilient and electrically insulating material and the upstanding portions (6A) are of stiffer electrically insulating material. At least two-thirds of the area of the pad (2) has none of the stiffer material above or below it. Preferably the upstanding portions (6A) are at least 150 mm. long and are on elongate members (6) which have ears (6B) at opposite ends which extend under only corners of the pad (2), where they are secured by spigots (2E) projecting into holes (6C).

12 Claims, 5 Drawing Sheets

FIG. 3.
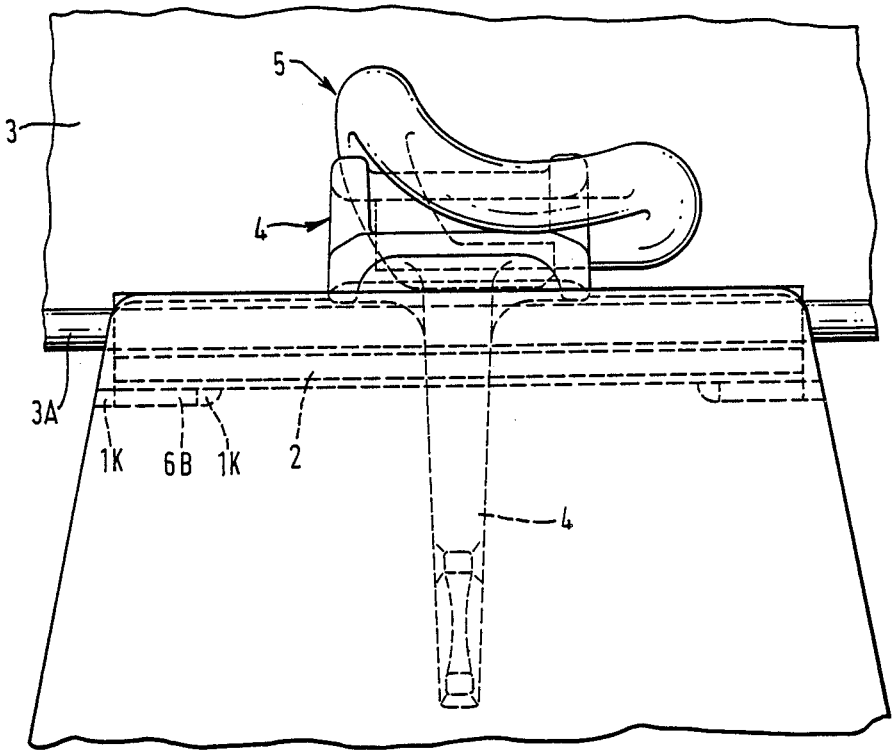
FIG. 7.
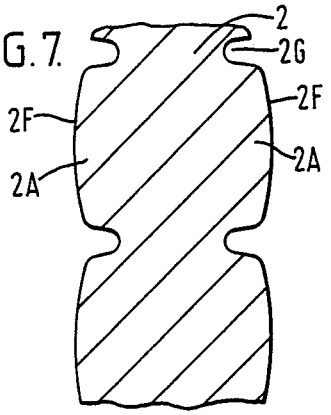
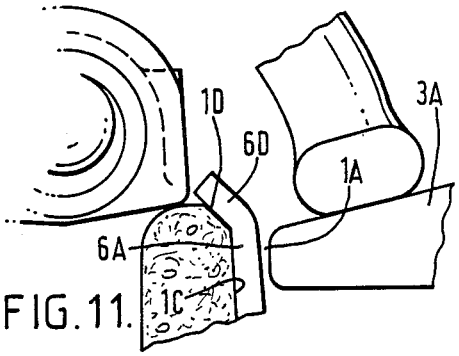
FIG. 11.

ELECTRICALLY INSULATING DEVICE FOR USE ON A RAILWAY TRACK UNDER AND BESIDE THE FOOT OF A RAIL

This invention relates to an electrically insulating device which is suitable for use on a railway track, under and beside the foot of a rail, to electrically insulate the rail from an underlying foundation which supports the rail.

BACKGROUND OF THE INVENTION

United Kingdom Patent Specification No. 967,329 discloses placing the flange at the bottom of a railway rail in two channel members, each comprising a single moulding of resilient and electrically insulating material which can be regarded as consisting of a pad portion, on which the flange of the rail rests, and two upstanding side wall portions extending upwardly from it to locate the flange of the rail and electrically insulate it from side walls of a recess in a concrete railway sleeper in which the channel members are inserted. If the pad portions are sufficiently soft, resilient and yieldable as to keep to an acceptable level the transmission of vertical impact forces from a passing train to the sleeper, the side wall portions, being of the same material as the pad portions, will be unable to resist satisfactorily the lateral forces exerted on them by the edge of the rail flange and the rail will move too far sideways as the train passes and too much chafing of the channel members will occur.

United Kingdom Patent Specification No. 2,114,635A discloses placing the flange at the bottom of a railway rail in a channel member comprising a single moulding of resilient and electrically insulating material which can again be regarded as consisting of a pad portion, on which the rail rests, and upstanding side wall portions of the same material extending upwardly from it, the side wall portions having metallic reinforcing bars embedded in them and extending along them. The bars are intended to overcome the above-mentioned disadvantage of the channel members of Specification No. 967,329 but the presence of the bars increases the cost and difficulty in making the channel member.

United Kingdom Patent Specification No. 1,427,974 discloses placing the flange of a rail in a channel member which is stated to be of "a suitable thermosetting or thermoplastic plastics material for example a phenolic resin, or polyurethane", high density polyethylene being given as an example. Since it is a channel member, it can be regarded as comprising an under-rail portion and two upstanding side wall portions extending upwardly from it to locate the rail. There is placed on the under-rail portion, between the side wall portions, a rubber liner or pad which does not have any upstanding portions and is stated to be "more resistant to physical wear, because high insulating properties are not required of it", which presumably means that the rubber pad or liner is more resistant to physical wear than is the channel member, although whether or not the rubber is of a grade which is as stiff as that of the channel member and whether or not the material of the liner or pad is such that it would normally be called an electrically insulating material in the art of electrically insulating railway rails is not made clear in the specification. It is known, however, that the invention has been exploited by putting on the market a stiff channel member with a less stiff or softer rubber liner or pad laid on the under-rail portion of the channel member. If the liner or pad is thin, there is not enough cushioning for the rail with regard to vertical impact forces and if the liner or pad is thick the total thickness of the material between the concrete and the bottom of the rail flange is too great; in other words the recess in the top of the concrete sleeper to receive this material is unacceptably deep so that the sleeper is weakened to an unacceptable degree.

SUMMARY OF THE INVENTION

It is an object of the invention to provide an electrically insulating device which goes under the foot of a rail and up both sides of the foot and which provides adequate cushioning under the rail foot without excessive thickness of material between the foundation which supports the rail and the bottom of the rail foot and with side wall portions of adequate stiffness to resist lateral thrust exerted by the rail.

According to the invention, there is provided a device which is suitable to be placed on a foundation for a railway rail and to have the rail standing on it, the device comprising a substantially rectangular pad of a first material on which the rail is to stand and two upstanding portions of a second material which is an electrically insulating material joined to the pad and extending upwardly from locations near two opposite edges of the pad, for locating the foot of the rail, characterised in that the pad is made of a resilient and electrically insulating material and the two upstanding portions are of a stiffer electrically insulating material, at least two-thirds of the area of the pad having none of the stiffer material above or below it.

Preferably at least 75% and, better still, at least 80% of the pad has none of the stiffer material above or below it.

The meaning of the statement that the second material is stiffer than the first, is that it is harder and less inclined to reduce its thickness when under a compressive force; in other words it is more rigid.

Preferably, the upstanding portions are on first and second elongate electrically insulating members which extend along said two opposite edges of the pad, neither of which members has a part which extends as much as half of the way across the pad towards the other member.

Each member may have no part whch extends above the pad but at least one part which extends under only the adjacent marginal portion of the pad and is there secured to the pad. For example, each member may have first and second ears at its opposite ends, each of which extends less than half of the way across the pad and under only a corner of the pad.

Each upstanding portion is preferably more than 150 mm. long, better still at least 200 mm. long.

The two upstanding portions of stiffer material could be bonded, by an adhesive or by a heating operation, to the pad after separate manufacture of the pad and said portions. Another possibility is to form the pad and said portions in a single moulding operation so that they emerge from the mould united. Alternatively, said portions could be mechanically secured to the pad, for example by projections in one member extending into recesses in another. This form of the device is the only one described below with reference to the accompanying drawings. It has the advantage that if one or two of the three parts of it becomes or become unacceptably worn or otherwise damaged but the other parts or other part are or is satisfactory, the unsatisfactory part or parts can be replaced without replacing the whole of the device.

BRIEF DESCRIPTION OF THE DRAWINGS

An example in accordance with the invention is described below with reference to the accompanying drawings, in which:

FIG. 3 shows a side view of what is shown in FIG. 1, FIG. 7 shows to a greater scale a portion of FIG. 6, FIG. 11 shows a view, corresponding to part of FIG. 1, of a modification of the assembly shown in FIG. 1.

DETAILED DESCRIPTION OF THE INVENTION

Figure 1:
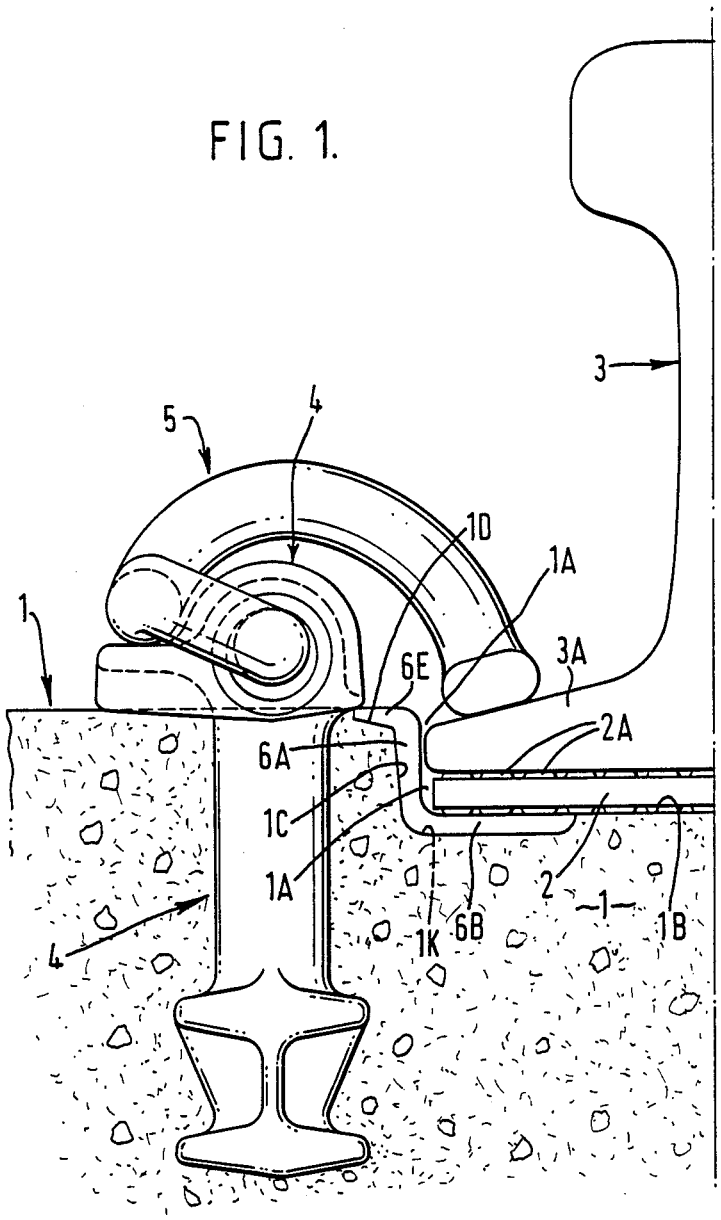
FIG. 1 shows an end view of part of an assembly comprising a railway rail secured to a concrete railway sleeper with an insulating device according to the invention interposed between the rail and the sleeper.
Figure 2:
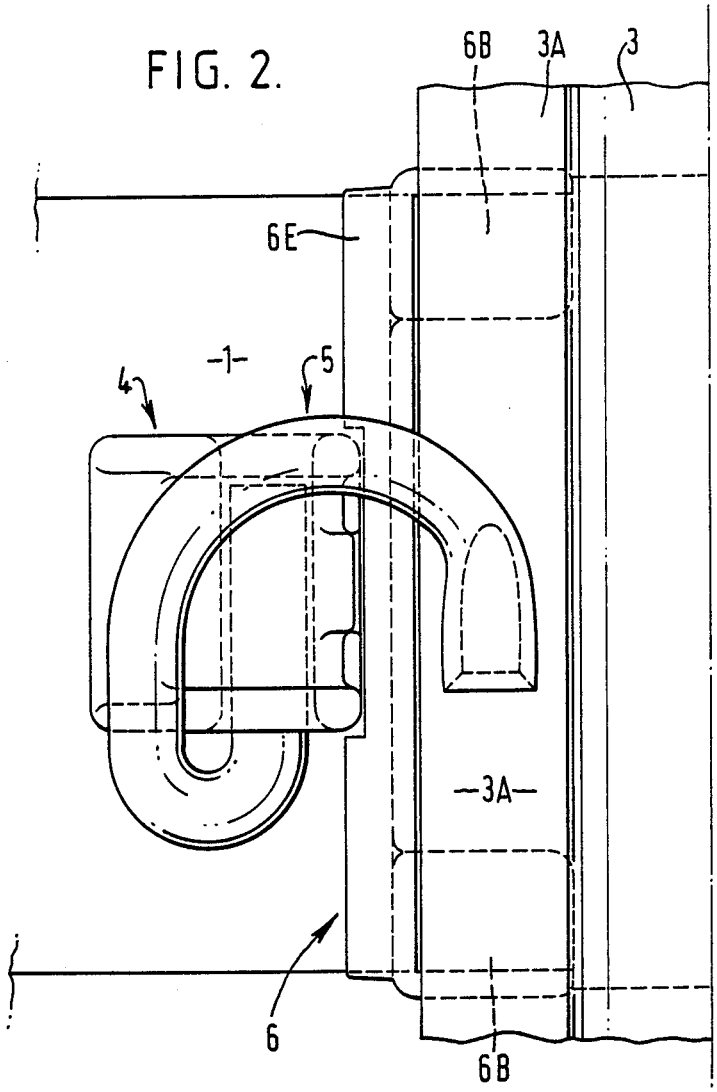
FIG. 2 shows a plan view of what is shown in FIG. 1.
Figure 6:
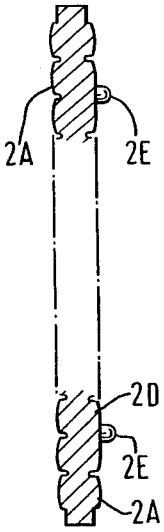

The drawings show a concrete railway sleeper 1 formed with a recess 1A extending across it which receives a pad 2, lying on the floor 1B of the recess, on which stands a flange-footed railway rail 3, a flange at the foot of the rail being referenced 3A. The pad is made of yieldable or soft resilient and electrically insulating elastomeric material, i.e. natural rubber or synthetic rubber, for example a polyether/polyamide copolymer or polyester. It consists of a flat rectangular plate 2H having staggered rows of bosses 2A, circular as seen in plan, integral with the plate and projecting upwardly from its upper face and downwardly from its lower face except along strips 2B near the edges of the plate. The rows are vertical in FIG. 4 and there are nineteen of them. At each end of alternate rows of bosses 2A there are larger bosses 2C, somewhat oval as seen in plan view. Each boss 2A or 2C projecting from the lower face of the plate 2H is directly opposite another boss 2A or 2C projecting from its upper face. At each corner of the plate, but on the lower face only, there is one larger boss 2D which is opposite three bosses 2A on the upper face of the plate. From this boss 2D and an adjacent boss 2A there project two spigots 2E. FIG. 7 shows that the tips 2F of the bosses 2A are convexly rounded and that the roots of the bosses 2A are rounded to provide rounded concavities 2G between adjacent bosses.

Inserted in the sleeper are two identical anchoring members 4 of cast malleable iron which receive two identical clips 5 which bear downwardly on the upper surfaces of the two sides of the flange 3A at the foot of the rail, the clips being so-called "e-clips". Only one anchoring member 4 and only one clip 5 are shown. Electrical insulation must be provided between the anchoring members and the concrete and/or between the clips and the anchoring members if, as in the illustrated case, it is not provided between the clips and the rail. In the illustrated case the insulation is provided in the form of a covering of an epoxy resin over each anchoring member.

Two identical elongate electrically insulating members 6 made of an electrically insulating material which is less yieldable, harder, stiffer and more rigid than the material of the pad, the members being of polyamide, Nylon 66 or high-density polyethylene, for example, are secured to the pad, these members both being either as shown in FIGS. 1 to 3 and 8 to 10 or like that but with the modification shown in FIG. 11. In each case the member 6 comprises an upstanding portion 6A which extends upwardly from a location near one of two opposite edges 2K of the pad. The portions 6A are in contact with inclined surfaces 1C which bound the recess 1A in the sleeper and thus the portions 6A locate the rail, i.e. prevent it moving more than a small distance to left or right, considering FIG. 1. Since the length of each portion 6A is approximately the same as the length of the pad 2, which in turn is approximately the same as the width of the top of the sleeper, the length of each portion 6A will usually be greater than 150 mm., typically above 200 mm. (212 mm. in the illustrated example), so that there is greater resistance to skewing of the sleeper than is afforded by the much shorter insulators, of L-shaped cross-section, which have hitherto been used on concrete sleepers with e-clips driven into anchoring members somewhat like the anchoring member 4; such insulators have had ears projecting from their vertical limbs on opposite sides of the anchoring members and between those ears they have abutted the anchoring members. There is also a greater area of insulating material to resist the lateral thrust and the attrition caused by vertical movement, as much as 1 mm. or even more, of the rail due to the nature of the pad. The fact that the portions 6A bear on the surfaces 1C and not on the anchoring members 4, as the insulators did hitherto, means that the tolerances on the dimensions and positions of the anchoring members 4 do not have to be taken into account in designing the members 6.

Each member 6 has two sideways-projecting feet or ears 6B extending from opposite ends of the portion 6A, these feet lying beneath the four corners of the pad and lying in and substantially filling four recesses 1K in the floor 1B of the recess 1A in the sleeper. Holes 6C through the feet 6B receive the spigots 6E on the pad and in that way the two members 6 are secured to the pad 2 before delivery of the device to the site. There could be only one or more than two spigots at each corner of the pad, received in a corresponding number of holes through the member 6. Of course, the spigots could be on the member 6 and the holes would then be in the pad.

Figure 4:
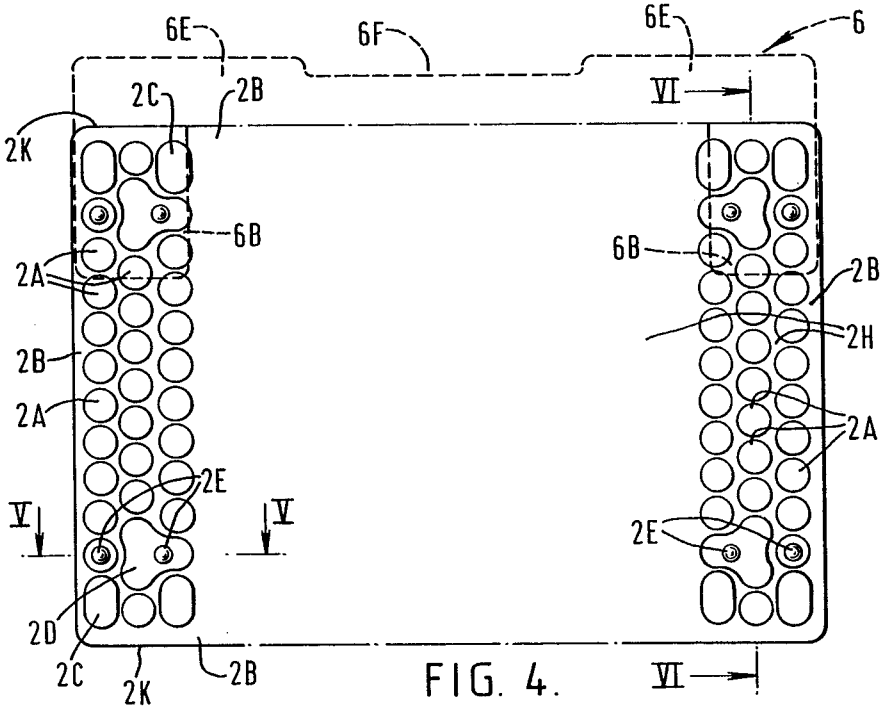
FIG. 4 shows an underneath plan view of a pad forming part of the insulating device shown in FIG. 1, FIGS. 5 and 6 show sectional views of parts of the pad, taken as indicated by the arrows V and VI, respectively, in FIG. 4.
Figure 5:
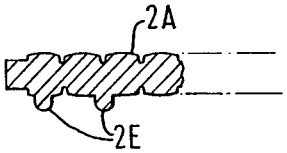
Figure 8:
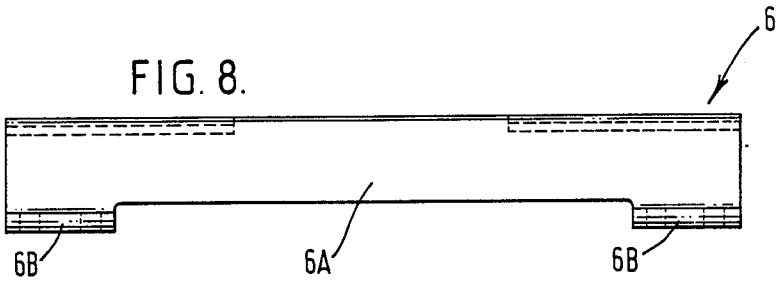
FIG. 8 shows a side view of another part of the insulating device shown in FIG. 1.
Figure 9:
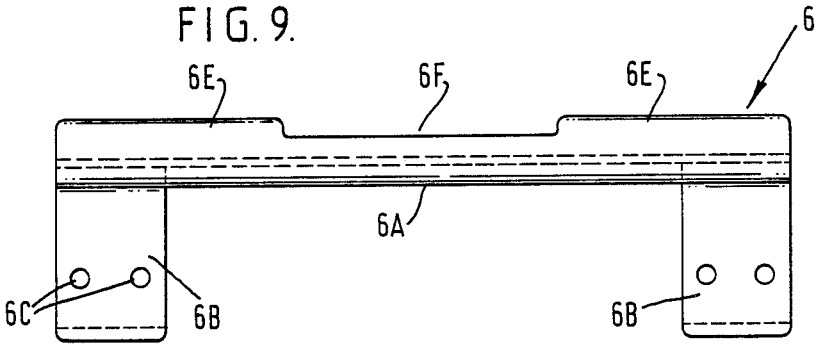
FIG. 9 shows a plan view of the part shown in FIG. 8.
Figure 10:
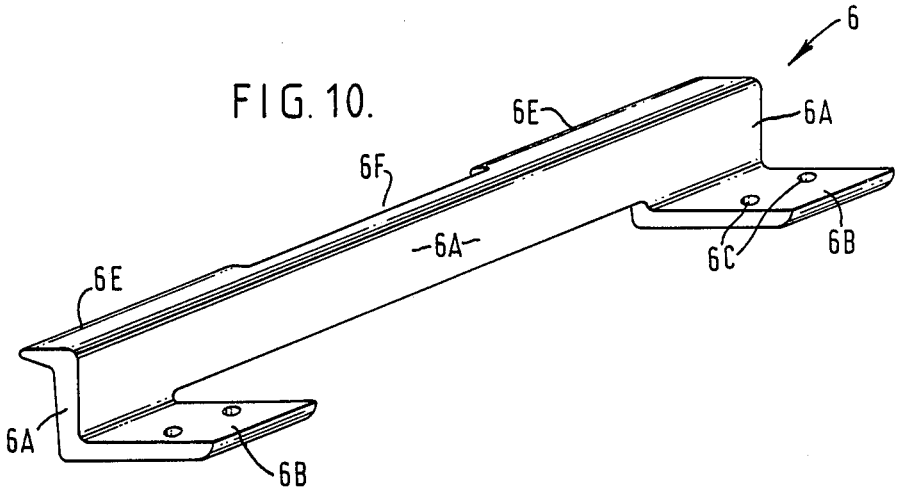
FIG. 10 shows a perspective view of the same part of the insulating device.

The lengths of the feet 6B in the illustrated case, measured vertically in FIG. 9, are much less than half, and in fact little more than a quarter, of the width of the plate, measured vertically in FIG. 4, and the widths of the feet 6B are even less, so that far more than two-thirds, and in fact about 85%, of the area of the pad 2 has none of the stiffer material under it. The whole of the area of the pad has none of the stiffer material above it. FIG. 4 shows in dotted lines the position of one of the members 6 when fitted to the pad 2.

In order to reduce the possibility of the rail catching on the top of the portion 6A when the rail is lowered into the recess 1A, the portion 6A has either a sideways-extending horizontal projection 6E, formed with a recess 6F to receive part of the adjacent anchoring member 4, lying in and substantially filling a recess in the top of the sleeper, in accordance with FIGS. 1, 2 and 8 to 10, or an extension 6D inclined by about 45° to the horizontal and adjacent an inclined surface ID on the sleeper, as shown in FIG. 11. The projections 6E or the extensions 6D on the two devices 6 project away from one another and they run the entire length of the portion 6A. Inclination of the rail is provided for, if required, by having the floor 1B of the recess 1A in the sleeper inclined to the horizontal when the bottom of the sleeper is horizontal, although this is not shown in the drawings.

Instead of having two spaced-apart feet or ears 6B lying in two separate recesses in the floor 1B of the recess 1A, there could be a single foot running approximately the entire length of the device 6 and of the pad 2 and lying in a single recess in the floor 1B, although the sleeper would then be less robust. With such a construction, if desired there could be two or more separate upstanding portions projecting upwardly from the foot, i.e. from locations near the edge of the pad, for example one near each end of the pad, in order to locate the rail. Another possibility is to secure four members of the harder electrically insulating material to the four corners of the pad, each member comprising a portion beneath the pad, a portion upstanding from a location near an edge of the pad and a portion inclined like the portion 6D or horizontal like the portion 6E.

Of course, the assembly of parts 2 to 6 at the other end of the sleeper 1 is the same as that described above and the invention could be applied also to the case where the foundation for the rail 3 is not a sleeper but a continuous slab of concrete extending along the railway track or is a concrete block which receives one rail and is connected by a tie to another block which receives the other rail.

I claim:

1. A device which is suitable to be placed on a foundation for a railway rail and to have the rail standing on it, the device comprising a substantially rectangular pad of a first material on which the rail is to stand and two upstanding portions of a second material which is an electrically insulating material extending upwardly from locations near two opposite edges of the pad, for locating the foot of the rail, the pad being made of a resilient and electrically insulating material, the two upstanding portions being of a stiffer electrically insulating material, and each upstanding portion having joined thereto at its upper end a respective sideways-extending portion, with the two sideways-extending portions projecting away from one another, at least two-thirds of the area of the pad having none of the stiffer material above or below it, and the pad being fastened to the upstanding portions so as to form therewith a unitary structure adapted to be placed as a unit onto a foundation of the rail and to permit placement of the rail onto the pad and between the upstanding portions without the latter impeding the lowering of the rail, in its upright position, vertically downwardly onto the pad.

2. A device according to claim 1 in which the upstanding portions are on first and second elongate electrically insulating members which extend along said two opposite edges of the pad, neither of which members has a part which extends as much as half of the way across the pad towards the other member.

3. A device according to claim 2 in which each member has at least one part which extends under only the adjacent marginal portion of the pad and is there secured to the pad and each member has no part which extends above the pad.

4. A device according to claim 3 in which each member has at each end an ear which extends less than half of the way across the pad and under only a corner of the pad.

5. A device according to claim 4 in which the upstanding portions ar more than 150 mm. long.

6. A device according to claim 5 in which at each corner of the pad at least one spigot projects downwardly from the lower face of the pad and into a hole through one of the ears of one of said members.

7. A device according to claim 1 in which each sideways-extending portion has a recess in it to receive part of a clip-anchoring member.

8. A device according to claim 1 in which each sideways-extending portion is inclined to the horizontal by about 45° when the pad lies on a flat horizontal surface.

9. A device according to claim 1 in which the pad has numerous bosses extending upwardly from its upper surface and numerous bosses directly opposite these and extending downwardly from the lower surface of the pad.

10. A device which is suitable to be placed on a foundation for a railway rail and to have the rail standing on it, the device comprising a substantially rectangular pad of a resilient and electrically insulating first material on which the rail is to stand and first and second elongate electrically insulating members extending along two opposite edges of the pad, respectively, said insulating members including respective first and second upstanding portions of a second material, which is an electrically insulating material stiffer than the first material, extending upwardly from locations near respective ones of said two opposite edges of the pad, for locating the foot of the rail, at least two-thirds of the area of the pad having none of the stiffer material below it, neither of said insulating members having a part which extends as much as half of the way across the pad towards the other insulating members, each insulating member being a separate structure from the pad and having at least one part which extends under only the adjacent marginal portion of the pad and is there secured to the pad, and each insulating member having no part which extends above the pad.

11. A device according to claim 10 in which each insulating member has at each end an ear which extends less than half of the way across the pad and under only a corner of the pad.

12. A device which is suitable to be placed on a foundation for a railway rail and to have the rail standing on it, the device comprising a substantially rectangular pad of a first material on which the rail is to stand and two upstanding portions of a second material which is an electrically insulating material joined to the pad and extending upwardly from locations near two opposite edges of the pad, for locating the foot of the rail, the pad being made of resilient and electrically insulating material and the two upstanding portions being more than 150 mm. long and of a stiffer electrically insulating material, at least two-thirds of the area of the pad having none of the stiffer material above or below it, the upstanding portions being on first and second electrically insulating members having opposite ends, and each insulating member having at each end an ear which extends under a corner of the pad, there being at each corner of the pad at least one spigot which projects downwardly from the lower face of the pad and into a hole through one of the ears of one of said members.

* * * * *